US005608499A

United States Patent [19]

Tanaka

[11] Patent Number: 5,608,499

[45] Date of Patent: Mar. 4, 1997

[54] APPARATUS AND METHOD FOR CLEANING ROLLERS IN IMAGE FORMERS

[75] Inventor: Masaru Tanaka, Kanagawa-ken, Japan

[73] Assignee: Ricoh Company, Ltd., Tokyo, Japan

[21] Appl. No.: 408,601

[22] Filed: Mar. 23, 1995

[30] Foreign Application Priority Data

Mar. 23, 1994 [JP] Japan ..... 6-051519

[51] Int. Cl.[6] ..... G03G 21/00

[52] U.S. Cl. ..... 399/99; 399/359

[58] Field of Search ..... 355/219, 296, 355/271, 298, 297

[56] References Cited

U.S. PATENT DOCUMENTS

| | | | |
|---|---|---|---|
| 3,552,850 | 1/1971 | Royka et al. . | |
| 4,894,688 | 1/1990 | Taniguchi et al. | 355/298 |
| 4,982,231 | 1/1991 | Matsuuchi | 355/206 |
| 5,148,227 | 9/1992 | Senba et al. | 355/296 |
| 5,250,997 | 10/1993 | Kaneko et al. | 355/298 |
| 5,289,241 | 2/1994 | Sugiyama et al. | 355/260 |
| 5,371,575 | 12/1994 | Sekino et al. | 355/210 |
| 5,455,661 | 10/1995 | Yoshida et al. | 355/219 |

FOREIGN PATENT DOCUMENTS

| | | |
|---|---|---|
| 58-81538 | 6/1983 | Japan . |
| 2-301779 | 12/1990 | Japan . |
| 3-100676 | 4/1991 | Japan . |

*Primary Examiner*—R. L. Moses
*Attorney, Agent, or Firm*—Lowe, Price, LeBlanc & Becker

[57] ABSTRACT

Accumulated toner and other particulate contaminants are removed from rollers, such as charging and transferring rollers, and conveyed to a collection receptacle positioned about the rotating path of an image bearing member, such as a photoconductive drum. In one embodiment, accumulated toner removed from a charging roller is recycled for development.

48 Claims, 2 Drawing Sheets

APPARATUS AND METHOD FOR CLEANING ROLLERS IN IMAGE FORMERS

TECHNICAL FIELD

The present invention relates to an image forming apparatus comprising means for cleaning a surface of a roller in contact with a surface of an image bearing member, such as a photoconductive drum. The invention has particular applicability to an image forming apparatus, such as a copying machine, optical printer, facsimile machine, and the like.

BACKGROUND ART

Conventional electrophotographic apparatus, such as copiers, printers, facsimile machines, etc., comprise an image bearing member, such as a photoconductive element, normally in the form of a drum or belt. Arranged in timed sequence around the image bearing member are a plurality of processing stations for performing various functions. These processing stations may comprise stations for charging the image bearing member, imagewise exposing the charged image bearing member to electrostatically form a latent image thereon, developing the latent electrostatic image with a developer commonly referred to as toner, transferring the toner developed image from the image bearing member to a substrate, such as paper, cleaning the image bearing member, i.e., removing residual toner and other contaminants from the surface of the image bearing member, and fixing the transferred toner developed image on the paper.

A typical reproduction operation comprises charging the image bearing member, such as a photoconductive drum, and exposing the charged surface to a light pattern of an original image to be reproduced, thereby selectively discharging the surface in accordance with the original image. The resulting pattern of charged and discharged areas on the surface of the photoconductive drum forms an electrostatic charge pattern or electrostatic latent image conforming to the original image.

The latent electrostatic image is developed by contacting it with finely divided toner which is held by electrostatic force on the image bearing member. The toner image is transferred to a substrate, such as paper, in a transferring device into which paper is fed by a registration roller toward the drum in synchronization with drum rotation. As the leading edge of the paper abuts the drum, electrostatic forces adhere the two together, and the transferring device transfers a toner image from the photoconductive drum to the paper. After transfer, the toner image is fixed to form a permanent record.

Subsequent to development, and after transfer of the developed image to the paper, some toner inevitably remains on the photoconductive drum, held thereto by electrostatic and/or Van der Wals forces. Additionally, other contaminants, such as dust, paper fibers, toner additives, Kaolins and various other forms of debris, have a tendency to be attracted to the charge retentive surface.

Contemporary commercial automatic copiers/reproduction machines, optical printers and facsimile machines comprise an electrostatographic image bearing member, which may be in the form of a drum or belt. The image bearing member moves at high rates in timed unison relative to a plurality of processing stations. This rapid movement of the electrostatographic image bearing member requires vast amounts of toner to be employed during development. Associated with the increased amounts of toner is the difficulty in removing residual toner remaining on the image bearing member subsequent to transfer.

One type of device conventionally employed for charging the image bearing member is a corona charger normally positioned slightly spaced apart from the surface of the image bearing member for applying a surface charge thereto. However, corona chargers are known to exhibit disadvantages, such as low charging efficiency, ozone generation, image blurring and high maintenance requirements. The disadvantages associated with corona chargers have led to the implementation of alternatives, such as a contact type charge inducing member, notable a charging roller, which is maintained in contact with the surface of an image bearing member, e.g., a photoconductive drum. The charging roller charges the photoconductive drum by contact while a voltage is applied to the charging roller, thereby charging the photoconductive drum at an advantageously relatively low voltage. Since a discharge is not established, ozone is not generated and the accumulation of dust on the wire electrode of a typical corona charger is avoided.

During operation, toner and other contaminants, including airborne particles, inevitably accumulate on the charging member, as from the surface of the photoconductive drum, particularly as the number of imaging cycles increases, thereby decreasing its charge inducing efficiency. In addition, toner and other contaminants, such as dust, tend to redeposit on the photoconductive drum, resulting in poor quality reproductions.

A prior attempt to address charging roller contamination is disclosed in Japanese Utility Model No. 58-81538, wherein toner and other contaminants are removed from the surface of a charging roller by contact with a fur-brush. Another prior approach is disclosed in Japanese Laid Open Patent No. 03-100676, wherein toner and other contaminants are removed from a charging roller with a foamed urethane sponge. In Japanese Laid Open Patent No. 02-301779, toner and other contaminants are removed by a cleaning member in the form of a web, such as a cloth web. These prior cleaning attempts have proved to be less than satisfactory.

The prior technique of removing toner and other contaminants from a surface of a charging roller by scraping with a fur-brush requires frequent periodic disposal of removed material, which is a time consuming and dirty manual operation. A receptacle is positioned remote from the image bearing member to accommodate removed material. However, it is necessary to remove the receptacle to dispose of the removed material at frequent intervals, which is manifestly costly and inefficient. The use of a sponge cleaning member also lacks efficiency due to its limited collection capacity which is reached quickly in normal operation. Therefore, an operator is required to exchange sponge cleaning members at frequent intervals. Cloth web cleaning members are also inefficient, since removed toner and other contaminants remain on the web causing gradual deterioration. Cloth web cleaning members also become impractical with large image forming apparatuses.

In a conventional image forming apparatus, a substrate, such as a sheet of paper, is fed to a transferring station wherein the toner developed image is transferred from the image bearing member to the paper, typically by means of a transferring roller. During operation, the surface of the transferring roller also becomes contaminated with toner and other particulate contaminants, thereby deteriorating the quality of the transferred image.

DISCLOSURE OF THE INVENTION

An object of the present invention is an image forming apparatus which reproduces images having improved quality.

Another object of the present invention is an image forming apparatus comprising means for efficiently removing accumulated toner and other contaminants from various components.

A further object of the present invention is an image forming apparatus comprising means for efficiently removing accumulated toner and other contaminants from various components without frequent maintenance.

A further object is more effective removal of accumulated toner and other contaminants from the surface of rollers which directly contact an image bearing member of an image forming apparatus.

Additional objects, advantages and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

According to the present invention, the foregoing and other objects are achieved in part by an image forming apparatus comprising: an image bearing member; a roller in contact with the image bearing member; and a cleaning unit comprising: a cleaning member for cleaning a surface of the roller by removing material therefrom; and transporting means for conveying the material removed from the surface of the roller away from the roller to a collection unit positioned about and in proximity to the image bearing member.

Another aspect of the invention is an improved image forming apparatus comprising: an image bearing member having a rotational path; at least one roller in contact with the image bearing member; and a cleaning member for cleaning a surface of the roller by removing material therefrom; wherein the improvement comprises transporting means for conveying the removed material to a collecting unit positioned along the rotational path of the image bearing member.

A further aspect of the present invention is an image forming apparatus comprising: an image bearing member having a rotational path; a charging roller in contact with the image bearing member; a transferring roller in contact with the image bearing member; a collecting unit positioned along the rotational path of the image bearing member, said collecting unit comprising a first collection receptacle and a second collection receptacle in communication with and removable from the first collection receptacle; a first cleaning member for removing toner and other contaminants from the surface of the charging roller and conveying the removed toner and other contaminants to the first collection receptacle; and a second cleaning member for removing toner and other contaminants from the surface of the transferring roller and conveying the removed toner and other contaminants to the second collection receptacle.

Yet another aspect of the present invention is an image forming method comprising: forming a latent image on the image bearing member in contact with at least one roller; dispensing toner to the image bearing member to develop the latent image; transferring the toner developed image from the image bearing member to a substrate; removing material from the surface of the roller; and conveying the removed material to a collecting unit positioned about and in proximity to the image bearing member.

Additional objects and advantages of the present invention will become readily apparent to those skilled in this art from the following detailed description, wherein only the preferred embodiment of the invention is shown and described, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE INVENTION

Figure 1:
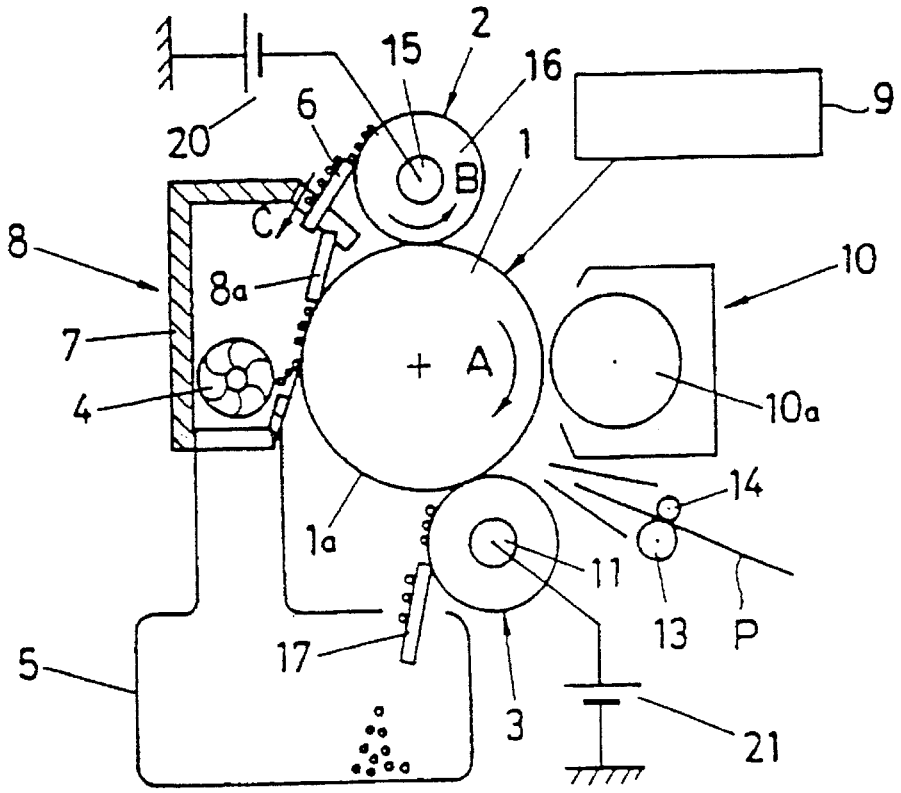
FIG. 1 is a schematic side view of an image forming portion of an image forming apparatus according to an embodiment of the present invention.

In describing preferred embodiments of the present invention illustrated in the drawings, specific terminology is not intended to be limited to the depicted and described elements, it being understood that each specific element includes all technical equivalents which operate in a similar manner to accomplish a similar purpose.

The present invention addresses the problems attendant upon the accumulation of material, such as toner and other contaminants, on surfaces of various components of a conventional image forming apparatus, particularly a charging roller, transferring roller and image bearing member, such as a photoconductive drum. During a typical image forming cycle, the image bearing member, such as a photoconductive drum, rotates about a predetermined timed path whereby the surface of the photoconductive drum is exposed to a plurality of processing stations for performing various functions, such as contacting a charging roller and contacting a transferring roller. During operation, toner and other contaminants accumulate on the surfaces of the charging roller and transferring roller, as well as the photoconductive drum. The accumulation of such unwanted toner and other contaminants deteriorate the quality of the resulting image. Conventional contaminant removal techniques have proved inefficient and troublesome. The present invention addresses and solves such problems by effectively removing toner and other contaminants from the charging roller, transferring roller and/or image bearing member, and conveying such removed toner and other contaminants away from the surface from which it is removed to a collecting unit positioned about and in proximity to the image bearing member, preferably along the predetermined path of the image bearing member, such as along the rotational path of a photoconductive drum. The removed material can be easily disposed of from the collecting unit at a convenient time, as during regularly scheduled maintenance, or recycled for development with a manifest attendant economic benefit.

An embodiment of the present invention is depicted in FIG. 1, wherein image bearing member 1, shown as a photoconductive drum, moves about a rotational path in the direction indicated by arrow A whereby surface 1*a* of photoconductive drum 1 is exposed to various processing units during an image forming cycle. As photoconductive drum 1 rotates, its surface 1*a* is sequentially exposed to a charging station, an exposure station, a developing station, a transferring station and a cleaning station. Thus, surface 1*a* of photoconductive drum 1 is uniformly charged by direct contact with charging roller 2 and image-wise exposed to light from exposing apparatus 9, thereby forming a latent electrostatic image on surface 1*a*. The latent electrostatic image is developed by toner dispensed to surface 1*a* of photoconductive drum 1 by developing sleeve 10*a* of developing unit 10, whereby the latent electrostatic image is visualized as a toner image.

A substrate, typically in the form of a paper sheet P, is fed, singly, from a paper sheet cassette (not shown) in predetermined timing by a rotating feeding roller. The top of fed paper sheet P is held temporarily by resist roller 13 and roller 14 which rotates and contacts resist roller 13 in timed relationship to the visible image. At a predetermined time, paper sheet P is transported toward the transferring station in which transferring roller 3 is positioned, wherein the toner developed image is transferred on the upper side of paper sheet P. After transfer of the toner developed image, the paper sheet P is transported to a fixing unit (not shown), wherein the transferred toner developed image is fixed on paper sheet P. After the transferred toner developed image is fixed, paper sheet P is discharged into a discharging tray (not shown) outside of the image forming apparatus.

Subsequent to the transferring operation, unwanted accumulated material, such as toner and other contaminants, remaining on photoconductive drum 1 are removed by cleaning blade 8*a* of cleaning unit 8, and any potential remaining on photoconductive drum 1 is removed by a charge erasing lamp (not shown). At this point, photoconductive drum 1 has completed one cycle of operation and is ready for the next charging operation.

Conveniently, toner and other contaminants removed from surface 1*a* of photoconductive drum 1 by cleaning blade 8*a* are collected in a collecting unit of cleaning unit 8 comprising collection receptacle 7. Preferably, the removed material is conveyed to a second collection receptacle 5 in communication with and removably mounted to first collection receptacle 7. Second collection receptacle 5 serves as a waste tank to store accumulated toner and other contaminants until convenient for disposition as during a regularly scheduled maintenance, thereby avoiding interruptions in operation. The removed material can be conveyed to second collection receptacle 5 by any convenient means, such as gravity or the illustrated transporting screw 4 provided within first collection receptacle 7. Thus, toner and other contaminants are effectively removed from surface 1*a* of photoconductive drum 1 and conveyed away from photoconductive drum 1 to collection receptacle 7 positioned about the rotational path of photoconductive drum 1, and subsequently conveyed to second collection receptacle 5 removably connected to first collection receptacle 7, thereby facilitating disposition of removed material at a convenient time.

It should be apparent from FIG. 1 that the charging roller 2 and transferring roller 3 are in direct contact with surface 1*a* of photoconductive drum 1. Typically, charging roller 2 comprises an electrically conductive core 15 made of an electrically conductive material, such as iron, and surrounding layer 16, typically comprising an electrically conductive rubber, formed on core 15. A charging voltage is supplied from power supply 20 to the electrically conductive core 15, whereby charging roller 2 uniformly charges surface 1*a* of photoconductive drum 1.

Both ends of electrically conductive core 15 of charging roller 2 are rotatably supported by electrical conductive bearings (not shown). Each bearing is urged toward photoconductive drum 1 (downward in FIG. 1) by a spring (not shown), and charging roller 2 is rotated in the direction indicated by arrow B while in contact with surface 1*a* of photoconductive drum 1.

The transferring roller 3 typically comprises an electrically conductive supporting shaft, a relatively thin elastic layer surrounding the supporting shaft 11, an electrically conductive layer on the elastic layer, and a relatively thin resist layer. A transferring voltage is applied to electrically conductive support shaft 11 from power supply 21.

As shown in FIG. 1, cleaning blade 6 is maintained in contact with the surface of charging roller at a predetermined contacting pressure, which can be easily optimized in a particular situation. Preferably, cleaning blade 6 is formed in the shape of a plate so that, in addition to facilitating scraping and removal of toner and other contaminants from the surface of charging roller 2, it also functions as a transporting means by conveying the removed toner and other contaminants away from the charging roller in the direction indicated by arrow C. Thus, toner and other contaminants are removed from the surface of charging roller 2 by blade 6 and the removed toner and other contaminants are conveyed to first collection receptacle 7 of cleaning unit 8 by sliding on the surface of plate-shaped cleaning blade 6.

Toner and other contaminants adhering to surface 1*a* of photoconductive drum 1 are removed by cleaning blade 8*a* subsequent to transfer of the developed toner image to paper sheet P. However, not all accumulated toner and other contaminants are removed from photoconductive drum 1 by cleaning blade 8*a*. Toner and other contaminants remaining on photoconductive drum 1 are brought into direct contact with charging roller 2, whereby such remaining accumulated toner and other contaminants are transferred to charging roller 2 during direct contact between charging roller 2 and surface 1*a* of photoconductive drum 1, particularly during charging. The accumulation of toner and other contaminants on charging roller 2 interferes with its charging function and consequently adversely affects the quality of the resulting image. The present invention solves that problem by efficiently removing toner and other contaminants from the surface of charging roller 2 by cleaning blade 6, preferably shaped to serve as a transporting means, such as a plate, to convey removed toner and other contaminants, which may include airborne toner and particulate contaminants, away from charging roller 2 to first collection receptacle 7.

Accumulated toner and other contaminant, not removed by cleaning blade 8*a* remaining on surface 1*a* of photoconductive drum 1 are also transferred to transferring roller 3, which is in direct contact with surface 1*a* of photoconductive drum 1. The accumulation of toner and other contaminants on the surface of transferring roller 3 negatively impacts the reproduced image. The present invention addresses this problem with cleaning member 17 which removes, as by scraping or abrasion, toner and other contaminants from the surface of transferring roller 3. The removed toner and other contaminants are conveyed to second collection receptacle tank 5. Preferably, cleaning blade 17 is shaped to function as a transferring means, such as a plate, so that it effectively removes toner and other contaminants from the surface of transferring roller 3, and also conveys the removed toner and other contaminants away from transferring roller 3 to second collection receptacle 5 positioned along the rotating path of the photoconductive drum 1.

In the preferred embodiment shown in FIG. 1, toner and other contaminants are removed from the surfaces of charging roller 2 and transferring roller 3 by cleaning blades 6 and 17, respectively. Preferably, cleaning blades 6 and 17 are in the form of plates so that they efficiently remove toner and other contaminants from the surfaces of the rollers and convey such removed material away from the rollers to collection receptacles positioned about the rotating path of photoconductive drum 1, thereby advantageously preventing the removed toner and other contaminants from redepositing on the surface 1*a* of photoconductive drum 1.

In the embodiment depicted in FIG. 1, toner and other contaminants are removed from charging roller 2 and transferring roller 3 by cleaning blades 6 and 17, respectively, are preferably conveyed to second collection receptacle or waste tank 5 which is removably attached to first collection receptacle 7. In this way, removal and collection of toner and other contaminants is effected without redeposition on other components of the image forming apparatus. By providing removable second collection receptacle 5 in an appropriate size and shape, disposition of material accumulated therein can be carried out cleanly and at time saving intervals less frequently than conventionally required.

Figure 2:
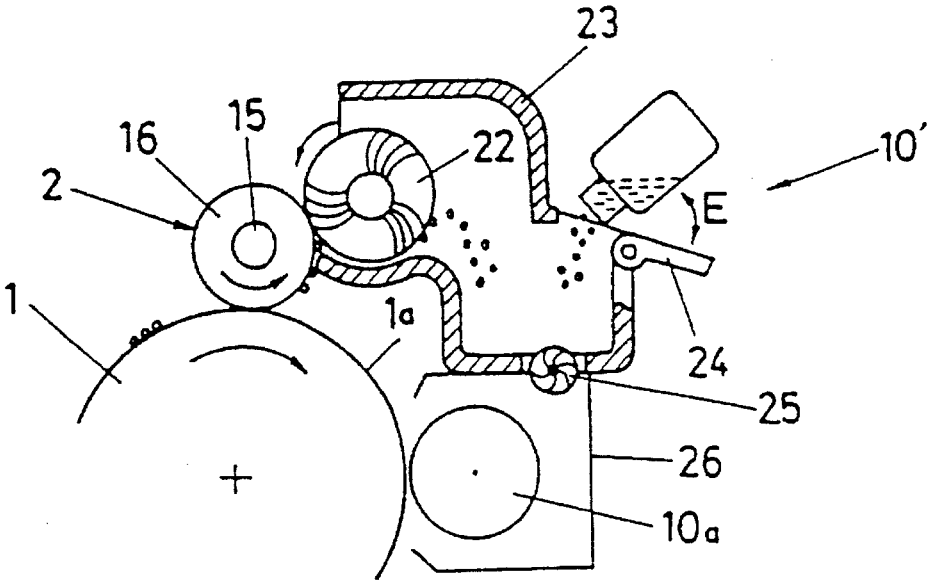
FIG. 2 is a schematic side view of an image forming portion of an image forming apparatus according to another embodiment of the present invention.

Another embodiment of the present invention is depicted in FIG. 2, wherein elements similar to those depicted in FIG. 1 bear similar reference numerals. Adverting to FIG. 2, the depicted section of an image forming apparatus according to this embodiment comprises means for removing toner and other contaminants from charging roller 2, primarily toner, and recycling removed toner to a developing station for use in developing a latent image on the photoconductive drum 1. In accordance with this embodiment, fur-brush 22 is provided to remove the accumulated material from the surface of charging roller 2. Fur-brush 2 preferably cooperates with a wall of collection receptacle 23 to function as a transporting means to convey removed material to collection receptacle 23 which is positioned about the rotating path of photoconductive drum 1. A plate-shaped cleaning member can also be employed in this embodiment.

Collection receptacle 23 is preferably provided as part of developing unit 10' and contains an entry port through which additional toner can be introduced. The entry port is closable by any conventional means, such as cap 24, which opens and closes in the directions indicated by arrow E. Removed material accumulated in collection receptacle 23, with or without replenished toner, is conveyed to developing tank 26 which communicates with collection receptacle 23. Material can be conveyed from collection receptacle 23 to developing tank 26 by any conventional means, such as by gravity and/or the depicted transporting screw 25.

In the embodiment shown in FIG. 2, material removed from the surface of charging roller 2 is stored and recycled, with or without additional toner, to photoconductive drum 1 by developing sieve 10*a*, thereby deriving an economic benefit attendant upon utilizing removed toner which would ordinarily be discarded. Advantageously, fur-brush 22 effectively removes toner from the surface of charging roller 2, and collection receptacle 23 is structured so that fur-brush 22 cooperates with a wall of collection receptacle 23 to convey the removed toner to collection receptacle 23 positioned along the rotating path of photoconductive drum 1. The disadvantage of frequent periodic disposition of accumulated removed toner is thereby avoided along with the economic waste attendant upon discarding removed toner.

Figure 3:
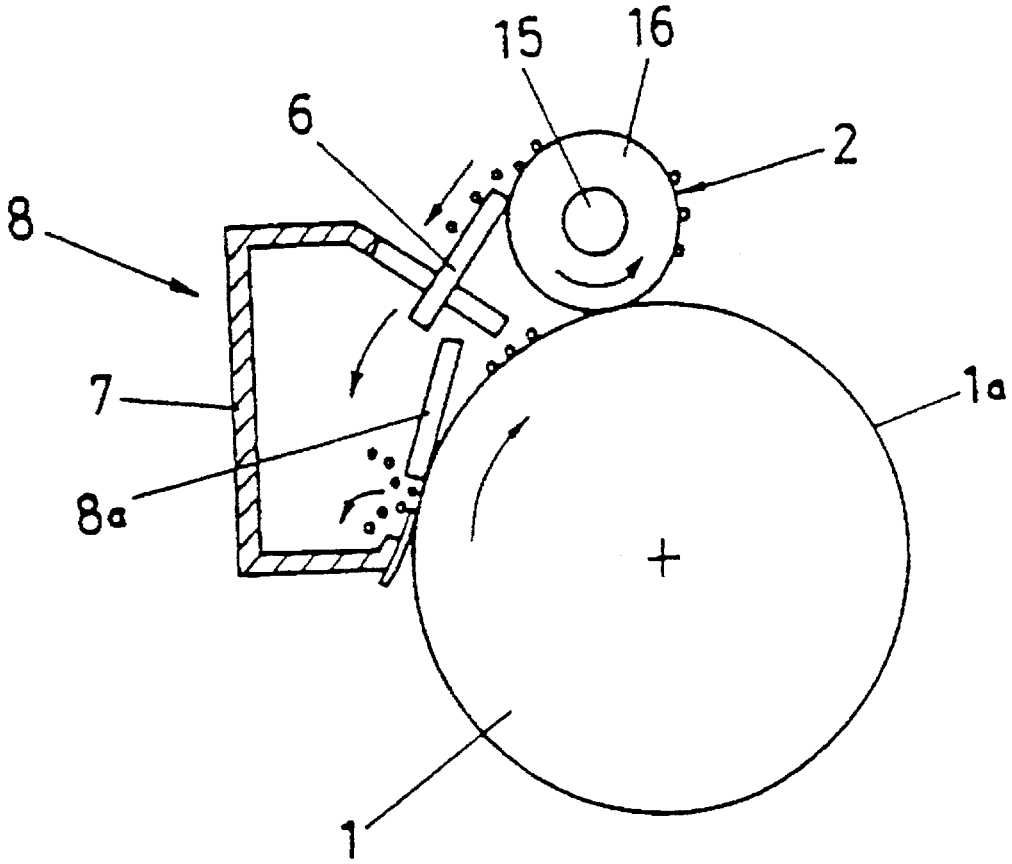
FIG. 3 is a schematic side view of an image forming portion of an image forming apparatus according to another embodiment of the present invention.

Another embodiment of the present invention is depicted in FIG. 3, wherein elements similar to those of the embodiment depicted in FIG. 1 bear similar reference numerals. As shown in FIG. 3, cleaning blade 6 removes accumulated toner and other contaminants from the surface of charging roller 2, and is preferably designed to function as a transporting means, as in the form of a plate, to convey removed toner and other contaminants away from charging roller 2 to collection receptacle 7 of cleaning unit 8. In a preferred aspect of this embodiment, cleaning blade 8*a* is provided to remove toner and other contaminants from surface 1*a* of photoconductive drum 1 for accumulation in collection receptacle 7 positioned along the rotating path of photoconductive drum 1. Collection receptacle 7 is, preferably, easily removable to enable disposition of the accumulated toner and other contaminants at a convenient time, as during regularly scheduled maintenance.

In the embodiments depicted in FIGS. 1 and 2, the use of transporting screws 4 and 25, respectively, increases the flexibility of the system, thereby enabling various design configurations and various transporting paths. Thus, transporting screws 4 and 25 facilitate the design of a compact apparatus.

In accordance with the present invention, the surfaces of rollers are maintained cleaned by a cleaning member for removing toner and other contaminants accumulated on the surfaces of the rollers. The removed toner and other contaminants are conveyed away from the rollers to a collection receptacle preferably positioned along the rotating path of a photoconductive drum 1. Thus, the present invention avoids the prior art disadvantages attendant upon employing a cleaning member which itself functions to collect removed toner and other contaminants such as a foamed methane sponge or cloth belt. Since it is not necessary to change the cleaning members themselves, maintenance requirements are significantly reduced. Moreover, the accumulated toner can be easily disposed of at a convenient time, as during regularly scheduled maintenance, or recycled to a developing unit. The efficient removal and disposition and/or recycling of accumulated toner in accordance with the present invention is conducted so that redeposition of removed material does not occur, thereby enabling the production of high quality images.

Another advantage of the present invention stems from the flexibility of employing relatively small collecting receptacles, thereby enabling the production of a compact image forming apparatus. In the embodiment of the present invention depicted in FIG. 2, recycling of removed toner for developing provides an economic advantage vis-à-vis discarding removed toner. In the embodiment depicted in FIG. 1, conveyance of toner and other contaminants removed from charging roller 2 and photoconductive drum 1 to second collection receptacle 5 advantageously enables storage of such removed material together with toner and other contaminants removed from the transferring roller, and simultaneous disposition of such removed material. The removal of toner and other contaminants from the charging roller also enhances charging performance, while the removal of toner and other contaminants from the surface of the transferring roller prevents soiling the rear side of a substrate with toner.

The use of a cleaning member which also functions as a transferring member in accordance with the present invention enables reduction in the number and size of components, thereby facilitating reducing the overall size of the image forming apparatus. The use of a plate-shaped cleaning member is preferred for its simplicity vis-à-vis a fur-brush which requires a rotating mechanism.

The foregoing embodiments are merely exemplary and not to be construed as limiting the basic concept of providing means for removing and toner and other contaminants which have accumulated on a charging roller and a transferring roller of an image forming apparatus, and conveying the removed material to a collection receptacle to avoid redeposition of such toner and other contaminants on the rollers or image bearing member, e.g., photoconductive drum. The present invention is useful in a variety of image forming type apparatus including, but not limited to copiers, printers, facsimile machines, etc. Only the preferred embodiment of the invention and but a few examples of its versatility are shown and described in the present disclosure. It is to be understood that the invention is capable of use in various other combinations and environments and is capable of changes or modifications within the scope of the inventive concept as expressed herein.

I claim:

1. An image forming apparatus, comprising:

an image bearing member;

a transferring roller for transferring a toner image formed on the image bearing member to a substrate, or a charging roller, in contact with the image bearing member; and a cleaning unit comprising:

a cleaning member for cleaning a surface of the roller by removing material therefrom; and transporting means for conveying the material removed from the surface of the roller away from the roller to a collecting unit positioned about and in proximity to the image bearing member, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

2. The image forming apparatus according to claim 1, wherein the image bearing member has a rotational path and the collecting unit is positioned along the rotational path.

3. The image forming apparatus according to claim 2, wherein the image bearing member is a photoconductive drum.

4. The image forming apparatus according to claim 1, wherein the collecting unit comprises a removable collection receptacle for disposing of removed material or a developing unit.

5. The image forming apparatus according to claim 4, wherein the collecting unit comprises a first collection receptacle in communication with the transporting means and in communication with a second collection receptacle which is removable for disposing of removed material.

6. The image forming apparatus according to claim 4, wherein the removed material comprises toner, and the collecting unit comprises a collection receptacle in communication with a developing unit for applying removed toner to a latent image on the image bearing member.

7. The image forming apparatus according to claim 6, wherein the collection receptacle contains a closable opening for receiving additional toner.

8. The image forming apparatus according to claim 6, wherein the cleaning member comprises the transporting means for conveying material removed from the roller to the receptacle.

9. The image forming apparatus according to claim 8, wherein the cleaning member operates in cooperation with a wall of the collection receptacle to convey the removed material to the collection receptacle.

10. The image forming apparatus according to claim 8, wherein the cleaning member comprises a plate.

11. The image forming apparatus according to claim 6, comprising means for conveying removed toner from the collection receptacle to the developing unit.

12. The image forming apparatus according to claim 11, wherein the means for conveying comprises a conveying screw.

13. The image forming apparatus according to claim 1, wherein the material removed comprises contaminant particles.

14. The image forming apparatus according to claim 1, wherein the material removed comprises toner.

15. The image forming apparatus according to claim 1, wherein the transporting means comprises gravity.

16. The image forming apparatus according to claim 1, wherein the cleaning member comprises the transporting means for conveying removed material to the collection unit.

17. The image forming apparatus according to claim 16, wherein the cleaning member comprises a plate.

18. The image forming apparatus according to claim 4, wherein the collecting unit comprises a removable collection receptacle for disposing of removed material.

19. An image forming apparatus, comprising:

an image bearing member;

a transferring roller for transferring a toner image formed on the image bearing member to a substrate, or a charging roller, in contact with the image bearing member; and a cleaning unit comprising:

a cleaning member for cleaning a surface of the roller by removing material therefrom; and transporting means for conveying the material removed from the surface of the roller away from the roller to a collecting unit positioned about and in proximity to the image bearing member, the removed material comprises toner, the collecting unit comprises a removable collection receptacle, for disposing of removed material, in communication with a developing unit for applying removed toner to a latent image on the image bearing member, and the means for conveying comprises gravity.

20. An image forming apparatus, comprising:

an image bearing member;

a transferring roller for transferring a toner image formed on the image bearing member to a substrate, or a charging roller, in contact with the image bearing member; and a cleaning unit comprising:

a cleaning member for cleaning a surface of the roller by removing material therefrom; and transporting means for conveying the material removed from the surface of the roller away from the roller to a collecting unit positioned about and in proximity to the image bearing member, wherein the roller is a charging roller for charging a surface of the image bearing member, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

21. The image forming apparatus according to claim 20, wherein the cleaning member comprises the transporting means for conveying the removed material to the collection unit.

22. The image forming apparatus according to claim 21, wherein the cleaning member comprises a plate.

23. An image forming apparatus, comprising:

an image bearing member;

a transferring roller for transferring a toner image formed on the image bearing member to a substrate, or a charging roller, in contact with the image bearing member; and a cleaning unit comprising:

a cleaning member for cleaning a surface of the roller by removing material therefrom; and transporting means for conveying the material removed from the surface of the roller away from the roller to a collecting unit positioned about and in proximity to the image bearing member, wherein the roller is a transferring roller for transferring a toner image formed on the image bearing member to a substrate, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

24. The image forming apparatus according to claim 23, wherein the cleaning member comprises the transporting means for conveying the removed material to the collection unit.

25. The image forming apparatus according to claim 24, wherein the cleaning member comprises a plate.

26. The image forming apparatus according to claim 23, wherein the substrate comprises a paper sheet.

27. An image forming apparatus, comprising:

an image bearing member;

a charging roller for charging a surface of the image bearing member in contact with the image bearing member; and a cleaning unit comprising:

a cleaning member for cleaning a surface of the roller by removing material therefrom; and transporting means for conveying the material removed from the surface of the roller away from the roller to a collecting unit positioned about and in proximity to the image bearing member, wherein the collecting unit comprises a removable collection receptacle for disposing of removed material, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

28. The image forming apparatus according to claim 27, wherein the cleaning member comprises the transporting means for conveying the removed material to the collection receptacle.

29. The image forming apparatus according to claim 28, wherein the cleaning member comprises a plate.

30. The image forming apparatus according to claim 29, further comprising a cleaning member for removing material from the image bearing member and conveying the removed material to the collection receptacle.

31. An image forming apparatus, comprising:

an image bearing member;

a charging roller in contact with the image bearing member; and a cleaning unit comprising:

a cleaning member for cleaning a surface of the roller by removing material therefrom; and transporting means for conveying the material removed from the surface of the roller away from the roller to a collecting unit positioned about and in proximity to the image bearing member, wherein the collecting unit comprises a removable collection receptacle for disposing of removed material or a developing unit, wherein the removed material comprises toner, and the collecting unit comprises a collection receptacle in communication with a developing unit for applying removed toner to a latent image on the image bearing member, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

32. An image forming apparatus, comprising:

an image bearing member;

a charging roller in contact with the image bearing member; and a cleaning unit comprising:

a cleaning member for cleaning a surface of the roller by removing material therefrom; and transporting means for conveying the material removed from the surface of the roller away from the roller to a collecting unit positioned about and in proximity to the image bearing member, wherein the collecting unit comprises a removable collection receptacle for disposing of removed material or a developing unit, wherein the collecting unit comprises a first collection receptacle in communication with the transporting means and in communication with a second collection receptacle which is removable for disposing of removed material, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

33. The image forming apparatus according to claim 32, wherein the cleaning member comprises the transporting means for conveying removed material to a collection unit.

34. The image forming apparatus according to claim 33, wherein the cleaning member comprises a plate.

35. An image forming apparatus, comprising:

an image bearing member;

a transferring roller for transferring a toner image formed on the image bearing member to a substrate, or a charging roller, in contact with the image bearing member; and a cleaning unit comprising:

a cleaning member for cleaning a surface of the roller by removing material therefrom; and transporting means for conveying the material removed from the surface of the roller away from the roller to a collecting unit positioned about and in proximity to the image bearing member, wherein the collecting unit comprises a removable collection receptacle for disposing of removed material or a developing unit, wherein the collecting unit comprises a first collection receptacle in communication with the transporting means and in communication with a second collection receptacle which is removable for disposing of removed material, and the removed material is conveyed from the first collection receptacle to the second collection receptacle by gravity.

36. An image forming apparatus, comprising:

an image bearing member;

a transferring roller for transferring a toner image formed on the image bearing member to a substrate, or a charging roller, in contact with the image bearing member; and a cleaning unit comprising:

a cleaning member for cleaning a surface of the roller by removing material therefrom; and transporting means for conveying the material removed from the surface of the roller away from the roller to a collecting unit positioned about and in proximity to the image bearing member, wherein the collecting unit comprises a removable collection receptacle for disposing of removed material or a developing unit, wherein the collecting unit comprises a first collection receptacle in communication with the transporting means and in communication with a second collection receptacle which is removable for disposing of removed material, and the removed material is conveyed from the first collection receptacle to the second collection receptacle by a transporting screw, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

37. In an image forming apparatus comprising an image bearing member having a rotational path, at least a transferring roller for transferring a toner image formed on the image bearing member to a substrate, or a charging roller, in contact with the image bearing member, and a cleaning member for cleaning a surface of the roller by removing material therefrom, the improvement wherein the cleaning member comprises transporting means for conveying the removed material to a collecting unit positioned along the rotational path of the image bearing member, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

38. The image forming apparatus according to claim 37, wherein the image bearing member is a photoconductive drum.

39. An image forming apparatus, comprising:

an image bearing member having a rotational path;

a charging roller in contact with the image bearing member;

a transferring roller in contact with the image bearing member;

a collecting unit positioned along the rotational path of the image bearing member, said collecting unit comprising a first collection receptacle and a second collection receptacle in communication with and removable from the first collection receptacle;

a first cleaning member for removing toner and other contaminants from the surface of the charging roller and conveying the removed toner and other contaminants to the first collection receptacle;

a second cleaning member for removing toner and other contaminants from the surface of the transferring roller and conveying the removed toner and other contaminants to the second collection receptacle, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

40. The image forming apparatus according to claim 39, further comprising a third cleaning member for removing toner and other contaminants from the image bearing member and conveying the removed toner and contaminants to the first collection receptacle.

41. The image forming apparatus according to claim 39, further comprising means for conveying removed toner and other contaminants from the first collection receptacle to the second collection receptacle.

42. The image forming apparatus according to claim 41, wherein the means for conveying comprises a conveying screw.

43. An image forming apparatus, comprising:

an image bearing member having a rotational path;

a charging roller in contact with the image bearing member;

a transferring roller in contact with the image bearing member;

a collecting unit positioned along the rotational path of the image bearing member, said collecting unit comprising a first collection receptacle and a second collection receptacle in communication with and removable from the first collection receptacle;

a first cleaning member for removing toner and other contaminants from the surface of the charging roller and conveying the removed toner and other contaminants to the first collection receptacle;

a second cleaning member for removing toner and other contaminants from the surface of the transferring roller and conveying the removed toner and other contaminants to the second collection receptacle; and means for conveying removed toner and other contaminants from the first collection receptacle to the second collection receptacle, wherein the means for conveying comprises gravity.

44. An image forming method, comprising:

forming a latent image on an image bearing member in contact with at least a transferring roller for transforming a toner image formed on the image bearing member to a substrate or a charging roller;

dispensing toner to the image bearing member to develop the latent image;

transferring the toner developed image from the image bearing member to a substrate;

removing material from the surface of the roller; and conveying the removed material to a collecting unit positioned about and in proximity to the image bearing member, wherein the cleaning member has a width or diameter substantially the same as the width or diameter of the roller, an edge of the cleaning member contacts the roller substantially along the entire width or diameter thereof, and the material removed from the roller by the cleaning member is transferred in a direction substantially perpendicular to an axis of the roller by the cleaning means and collected by the collecting unit.

45. The image forming method according to claim 44, further comprising conveying the removed material to a removable receptacle.

46. The image forming method according to claim 44, wherein the removed material comprises toner.

47. The image forming method according to claim 46, comprising conveying the removed toner to a developing unit and dispensing the removed toner to the image bearing member to develop a latent image.

48. The image forming method according to claim 47, wherein the removed toner is mixed with additional toner and dispensed to the image bearing member.

* * * * *